United States Patent [19]

McGee, Sr.

[11] Patent Number: 4,858,456

[45] Date of Patent: Aug. 22, 1989

[54] RESETTABLE AXIAL TUMBLER LOCK

[76] Inventor: Rodney M. McGee, Sr., Rte. 4, Box 703, Lincolnton, N.C. 28092

[21] Appl. No.: 178,428

[22] Filed: Apr. 6, 1988

[51] Int. Cl.[4] ..... B05B 27/08

[52] U.S. Cl. ..... 70/491; 70/383

[58] Field of Search ..... 70/491, 382–384

[56] References Cited

U.S. PATENT DOCUMENTS

| | | | |
|---|---|---|---|
| 1,561,223 | 11/1925 | Fremon | 70/382 |
| 2,113,007 | 4/1938 | Swanson | 70/382 |
| 3,595,043 | 7/1971 | Williams | 70/383 |
| 3,648,492 | 3/1972 | Walters et al. | 70/491 |
| 3,729,964 | 5/1973 | Hsu | 70/382 X |

*Primary Examiner*—Lloyd A. Gall

*Attorney, Agent, or Firm*—Laurence R. Brown; Alfred J. Mangels

[57] ABSTRACT

An axial tumbler pin lock that includes an inner cylindrical body and a pair of abutting, coaxially positioned first and second inner sleeves that are rotatably carried on the cylindrical body and are capable of relative rotation with respect to each other and with respect to the cylindrical inner body. The cylindrical inner body includes a stepped portion that abuts an inner sleeve to define a transversely extending locking plane. The respective abutting faces of the second inner sleeve and the inner cylindrical body define a transversely extending first reset plane, and the abutting faces of the first rotatable sleeve and the second rotatable sleeve define a transversely extending second reset plane. The lock is adapted to receive a first reset key to permit relative rotation between the innermost or second sleeve relative to the cylindrical inner body to permit realignment of axially extending tumbler pins carried in circumferentially spaced bores in each of the cylindrical inner body and the first and second rotatable sleeves, to thereby require that a different operating key be used to operate the lock. A second reset key is provided and is so configured in such a way that the tumblers are positioned so that relative rotation is possible between the first and second inner rotatable sleeves, to provide a further set of tumbler orientations to require additional operating keys in order to operate the lock.

13 Claims, 4 Drawing Sheets

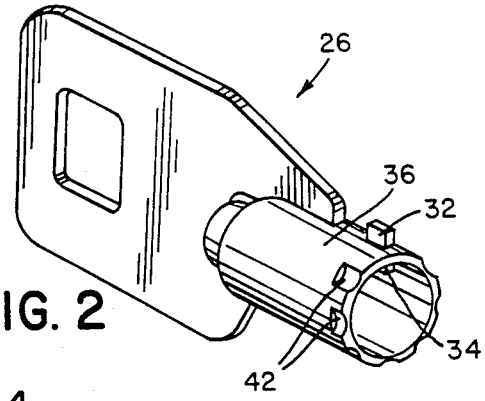
FIG. 2
FIG. 1
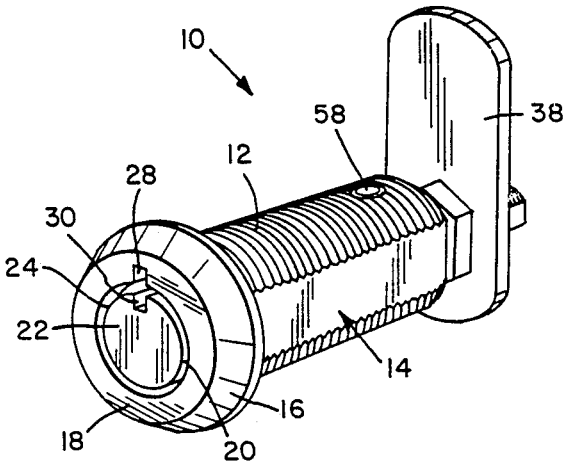
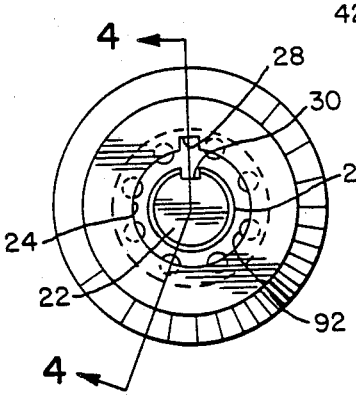
FIG. 3
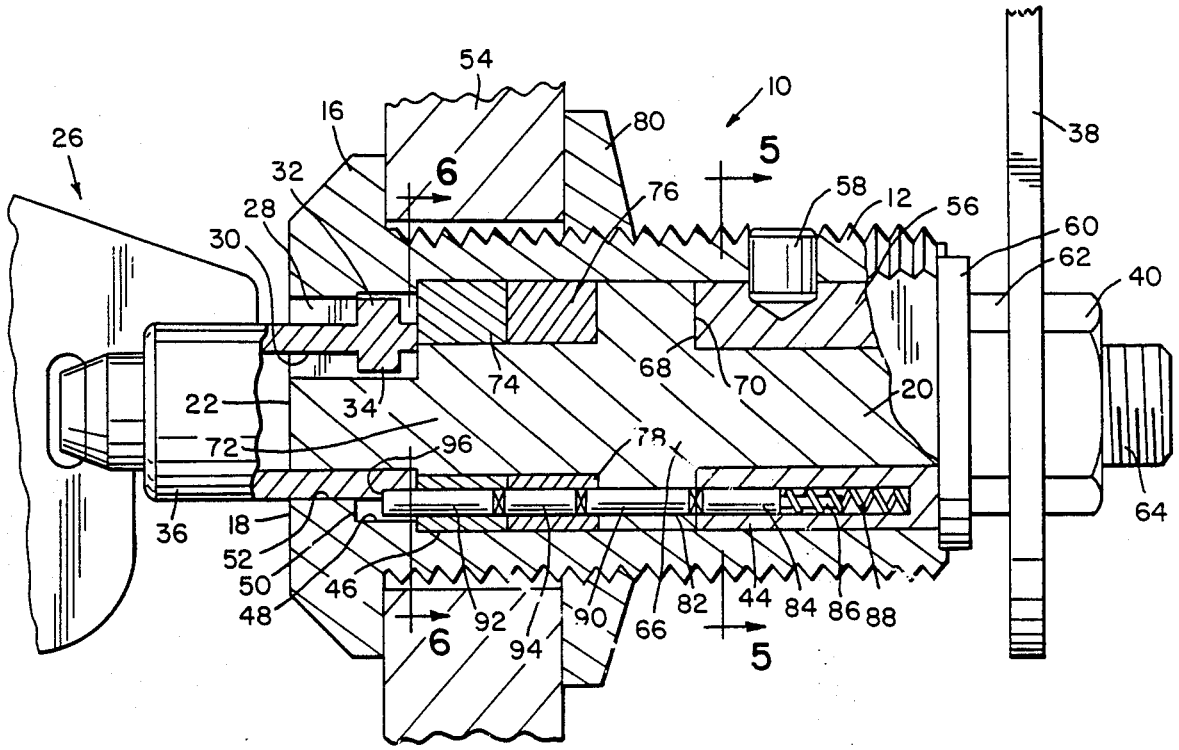
FIG. 4

RESETTABLE AXIAL TUMBLER LOCK

BACKGROUND OF THE INVENTION

1. Field of the Invention

The present invention relates to axial pin tumbler locks, and more particularly to an improved axial pin tumbler lock in which the tumblers are resettable to provide a large number of tumbler configurations that require separate operating keys, in order to permit the lock to be reset a large number of times to different operating configurations, on a periodic basis, if desired, so that the same operating key is usable for only a single combination of the lock tumblers, in order to prevent access to the area that is locked in the event an operating key is lost or is in the possession of an unauthorized person.

2. Description of the Related Art

Axial tumbler pin locks have been in use for some period of time, and a number of configurations of such locks have been disclosed. For example, in U.S. Pat. No. 3,541,819, which issued Nov. 24, 1970, to W. J. Kerr, an axial pin tumbler lock is disclosed in which a tumbler ball is included among and positioned between two of the generally cylindrical tumbler pins, in order to provide a lock structure that prevents tampering with the locks by unauthorized persons, and prevents unauthorized opening of the lock by the manipulation of a lock picking tool. However, the lock structure disclosed in that patent is operable by only a single key, and therefore if the key were to be lost or improperly acquired, the finder or acquirer of the key would be able to open the lock, and to obtain access to the area intended to be secured.

In order to minimize the risk of an unauthorized person having access to the area sought to be secured, a resettable axial tumbler pin lock was disclosed by D. J. Monahan in U.S. Pat. No. 3,422,646, which issued on Jan. 21, 1969. The lock disclosed in the Monahan patent includes a plurality of small, so-called wafers that are housed within a stationary annular body, and permit the tumblers to be reset so that a new operating key is required to open the lock. However, a limited number of resettable positions is available, and, additionally, the provision of a large number of very small wafers renders the lock very difficult to assemble and to repair, if necessary.

An improved form of a resettable axial tumbler pin lock is disclosed in U.S. Pat. No. Re. 28,319, which issued Jan. 28, 1975, to W. J. Kerr, and is based upon earlier-issued U.S. Pat. No. 3,756,049. In the Kerr reissue patent a lock structure is disclosed in which fewer parts are required that in the Monahan lock structure, but, again, only a limited number of tumbler combinations is available, specifically eight, and it is desirable that an even larger number of tumbler combinations be provided in order to reduce the likelihood that an unauthorized person in possession of an operating key will be able to open the lock when the tumbler pins are properly aligned to permit operation of the lock with such an operating key.

It is an object of the present invention to overcome the deficiencies of the prior art structures as hereinabove described, and to provide an improved axial pin tumbler lock structure in which a large number of different tumbler combinations can be provided, requiring a large number of different operating keys, in order to render unauthorized entry into the area locked by such a lock to be substantially less likely than would otherwise be the case. Summary of the Invention Briefly stated, in accordance with one aspect of the present invention, an improved axial pin tumbler lock is provided that includes a tubular housing that has an axis and that includes an annular key opening to accept a tubular key having circumferentially spaced peripheral notches thereon. The annular key opening includes a radially outwardly extending notch and a radially inwardly extending notch. An inner cylindrical member defines the inner portion of the annular key opening, and is rotatably carried within the tubular housing. The housing also includes an inner annular sleeve non-rotatably carried by the housing at its innermost end, the sleeve having an internal bore adapted to rotatably receive the inner cylindrical member. The inner cylindrical member inlcudes a cylindrical inner end portion adapted to be rotatably received in the annular sleeve, and having a cylindrical outer portion that extends to the front part of the lock and defines the inner surface of the annular key opening. Positioned intermediate the inner and outer end portions of the inner cylindrical member is an annular stepped portion that extends radially outwardly from the axis to define a cylindrical intermediate portion that is supported within the tubular housing and is rotatable with respect thereto. First and second annular sleeves are rotatably carried on the outer end portion of the cylindrical inner body and are also rotatably received within the tubular housing. The first and second sleeves are in co-axial arrangement on the cylindrical inner body and are in contact with each other. Each of the first and second inner rotatable sleeves and the enlarged annular step portion of the cylindrical inner body includes a plurality of circumferentially disposed bores that extend in an axial direction relative to the axis of the cylindrical inner body, and that are capable of being placed into axial alignment with each other. The bores are disposed in a substantially circular array, and each bore is adapted to receive a plurality of cylindrical tumbler pins.

The inner cylindrical sleeve member also includes a plurality of axially extending bores disposed as a substantially circular array and capable of alignment with the bores in the first and second annular member and the stepped annular portion of the cylindrical inner body. The bores in the inner cylindrical sleeve member are blind bores and terminate inwardly of the axially spaced end faces of the sleeve.

The bores in each of the first and second sleeve members and the annular step portion each extend completely through the respective parts to permit tumbler pins to be shifted within the respective bores. The blind bores in the cylindrical sleeve member each include spring means that serve to urge the tumbler pins toward the front face of the lock housing.

The housing includes an inwardly extending circular flange positioned adjacent its outer face to engage at least a portion of an outer end of the outermost tumbler pins to limit outward axial movement of each of the axial groups of tumbler pins.

The interface between the stationary annular sleeve and the rotatable cylindrical member defines a locking plane. The interfaces between the annular stepped portion of the rotatable cylindrical member and the second rotatable sleeve member, as well as the interface between the first and second rotatable sleeve members each define respective reset planes. Each of the two reset planes is axially spaced from the other, and is also axially spaced from the locking plane.

The tumbler pin lengths are selected so that a first tubular reset key having external notches and engageable with the outermost ends of the outermost tumbler pins provides alignment of the tumbler ends to permit relative rotation of the second annular sleeve relative to the rotatable cylindrical inner body member to reset the tumblers to a plurality of first positions corresponding with the number of axial bores. The tumbler pins also permit a second tumbler reset key that provides alignment of the tumbler ends to permit relative rotation of the first and second inner annular sleeve members relative to each other in order to reset the tumblers to a plurality of second positons corresponding with the number of axial bores.

BRIEF DESCRIPTION OF THE DRAWINGS

FIG. 1 is a perspective view of an axial pin tumbler lock in accordance with the present invention.

FIG. 2 is a perspective view of an operating key that can be used to lock and unlock the lock illustrated in FIG. 1.

FIG. 3 is a front view of the lock of FIG. 1.

FIG. 4 is an enlarged, fragmentary cross-sectional view of the lock of FIG. 1, taken along the line 4—4 of FIG. 3, with an operating key inserted into the key opening of the lock.

DESCRIPTION OF THE PREFERRED EMBODIMENTS

Figure 6:
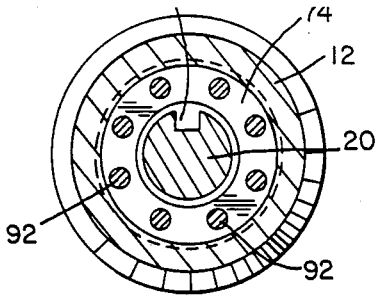
FIG. 6 is a cross-sectional view taken along line 6—6 of FIG. 4.

Referring now to the drawings, and particularly to FIGS. 1 and 2 thereof, there is shown an axial tumbler pin lock 10 in accordance with the present invention. Lock 10 includes a tubular housing 12 that has an external thread to permit it to be threadedly received in a correspondingly threaded and sized opening, if desired. Housing 12 includes a pair of opposed flats 14, only one of which is visible in FIG. 1, to permit housing 12 to be non-rotatably retained in position in a correspondingly shaped hole in a door or other panel (not shown) that is intended to be locked. Housing 12 includes a frustoconical front wall 16 that terminates in a flat outer surface 18. An cylindrical inner body member 20 is positioned within housing 12, and includes a front wall 2 that is coplanar with outer surface 18 of housing 12. Front wall 22 of cylindrical inner body member 20 is of a smaller diameter than that of an opening in outer surface 18, to define a generally annular opening 24 that is adapted to receive a tubular operating key 26 as illustrated in FIG. 2. Annular opening 24 includes an outer notch 28 that extends in an upward direction, and an inner notch 30 that extends in a downward direction, as viewed in FIG. 1, and each of notches 28 and 30 is adapted to receive a correspondingly shaped lug, 32, 34 (see FIG. 2) that is positioned on the outer and inner surfaces, respectively, of the tubular body 36 of key 26. At the rearmost end of housing 12 is positioned a locking tab 38, that is secured to and carried by inner cylindrical body member 22 by means of a nut 40 (see FIG. 4).

As will be appreciated by those skilled in the art, lock 10 is operated by inserting key 26 into annular opening 24. As seen in FIG. 2, the outer surface of tubular body 36 of the key includes a series of axially extending, partially cylindrical notches 42 that cooperate with correspondingly positioned axial tumblers (not visible in FIGS. 1 and 2), the structure and operation of which will be hereinafter described. Key 26 is inserted into the lock so that the inner and outer lugs 34 and 32 are received in the corresponding notches 30 and 28, and when the key has been moved inwardly until further movement is no longer possible, the key can be turned to turn locking tab 38 and disengage it from a portion of lock structure (not shown) in order to permit access to the space that is secured by the lock. Return of locking tab 38 to its locking position is effected by turning the key until the outer and inner notches 28 and 30 are in the aligned position as shown in FIG. 1, whereupon the key can be withdrawn.

The internal structure of the lock is best seen in FIG. 4, which is a cross-sectional view taken along the line 4—4 of FIG. 3, which, in turn, is a front view of the front face of the lock. As is apparent from FIG. 4, outer surface 18 of the lock is integral with tubular housing 12, and the latter includes a first cylindrical inner surface 44, that extends along the majority of the axial length of the housing, and that terminates at a point spaced inwardly of outer surface 18 in a first inwardly extending shoulder 46. A first reduced diameter cylindrical portion 48 extends forwardly of the shoulder to define a cylindrical volume that is adapted to completely receive outer lug 32 of key 26 so that rotation of outer lug 32 is unimpeded to permit full rotation of key 26 as it is rotated while in annular opening 24. First reduced diameter cylindrical portion 48 extends forwardly toward outer surface 18 and terminates inwardly thereof at a second inwardly extending shoulder 50 from which a second reduced diameter portion 52 extends forwardly to outer surface 18 of the lock.

At the innermost portion of tubular housing 12, relative to the wall 54 of the door or panel in which the lock is positioned, an inner tubular sleeve 56 is positioned and is restrained against rotation relative to housing 12 by means of dowel pin 58, or the like. A washer 60, a nut 62, locking tab 38, and locking nut 40, are applied to the threaded innermost end 64 of cylindrical inner body member 20. Positioned intermediate the ends of cylindrical inner body member 20 is an intermediate concentric ledge portion 66 that has an outer diameter substantially the same as the inner diameter of tubular housing 12 in order to permit relative rotation therebetween. Concentric ledge portion 66 is so positioned as so have its rearmost surface 68 in abutting contact with the forwardmost surface 70 of inner sleeve 56.

The forward portion 72 of cylindrical inner body 20, relative to ledge portion 66, carries a pair of concentrically arranged first and second inner rotatable sleeves, 74 and 76, respectively, each of which has an outer diameter that corresponds substantially with the inner diameter of housing 12 to permit relative rotation therebetween, and each sleeve includes an inner diameter that permits relative rotation between the respective sleeves and the cylindrical inner body member 20. First inner sleeve 74 has its forward radial face adjacent first shoulder 46 and its rearmost radial face in abutting contact with the forward radial face of second sleeve 76, and the latter, in turn, has its rearmost radial face in abutting contact with the forwardmost radial surface 78 of intermediate concentric ledge 66. Each of cylindrical inner body 20, and first and second inner sleeves 74 and 76, respectivley, is capable of relative rotation with respect to each other, as well as with respect to housing 12.

As best seen in FIG. 4, the rearmost surface of front wall 16 of housing 12 is in abutting relationship with the front face of wall 54 of a door or panel that includes an opening to receive lock housing 12. A retaining nut 80 is provided on the opposite side of wall 54 and engages with the thread formed on the outer surface of housing 12 to securely position lock 10 on the door or panel at the desired location.

Each of first and second inner sleeves 74 and 76, as well as inner concentric ledge portion 66 and inner sleeve 56 includes a plurality of axially extending, circumferentially spaced bores 82 that are positioned in such a way that their axes define a circle of predetermined radius relative to the axis of the housing and concentric with the housing axis. Each of bores 82 has the same diameter, and each bore extends completely through each of first and second inner sleeves 74 and 76, as well as through intermediate concentric ledge 66, but the bores in inner sleeve 56 extend inwardly from forward surface 70 to a point that is forward of the rear surface of sleeve 56 to define a plurality of blind bores therein.

Positioned within each of bores 82 is a plurality of tumbler pins, four of which are illustrated. An innermost pin 84 extends into inner sleeve 56 and includes a reduced diameter rearwardly extending central cylindrical guide portion 86, about which is carried a compression spring 88 that acts against innermost pin 84 to urge it in a forward direction. An operating pin 90 is positioned immediately forwardly of and in contact with the forward end of innermost pin 84, and first and second reset pins 92 and 94, respectively, are positioned forwardy of operating pin 90. Because the respective pins are in end-to-end contact, each of the pins is urged forwardly by spring 88 until first reset pin 92 is in contact with second inward shoulder 50.

Figure 5:
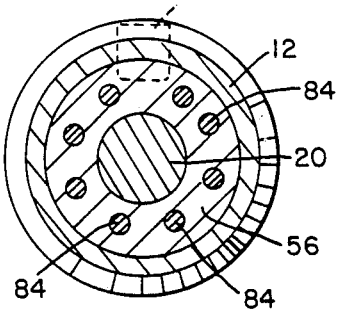
FIG. 5 is a cross-sectional view taken along line 5—5 of FIG. 4.

As best seen in FIGS. 3, 5, and 6, eight circularly positioned bores 82 are provided, the number corresponding with the number of circumferential cylindrical notches 42 formed in an operating key 26. As best seen in FIG. 3, the respective outermost tumbler pins each have a portion of their forwardmost ends in contact with second inward shoulder 50, and a portion that extends inwardly into annular opening 24. Thus, when a key is inserted into opening 24, as shown in FIG. 4, the rearmost ends 96 of the respective circumferential notches on the key engage the outer ends of the respective forwardmost tumbler pins to move them in an axial direction toward the rear portion of housing 12 a distance that depends on the axial length of the respective circumferential notches 42.

The tumbler pins are preferably solid cylinders and are preferably of various axial lengths. The lengths are so selected that when a key is inserted into the lock opening, the respective tumblers are so arranged that the interface between the innermost pins 84, which are hereinafter referred to as the biasing pins, and the operating pins 90 lie in a single axial plane that coincides with the radial interace between the forward end of inner sleeve 56 and rearmost surface 68 of inner ledge portion 66. When the pins are so positioned, to permit relative rotation between inner ledge portion 66 and inner sleeve 56, turning the key serves to turn locking tab 38 to unlock the lock and thereby permit access to the area intended to be secured by the lock. Rotation of the key can be in either a clockwise direction or a counterclockwise direction, and when it is intended to resecure the area and again place the lock in the locked position, the operating key is again turned in an opposite direction until outer lug 32 is aligned with outer notch 28, whereupon the key can be readily withdrawn from opening 24. While the key is inserted and is in its innermost position, outer lug 32 is received in the volume defined by the annular space rearward of second inward shoulder 50.

Figure 7:
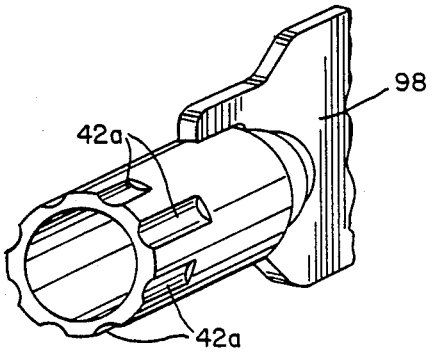
FIG. 7 is a fragmentary perspective view of one form of reset key that can be used with the lock illustrated in FIG. 1.
Figure 8:
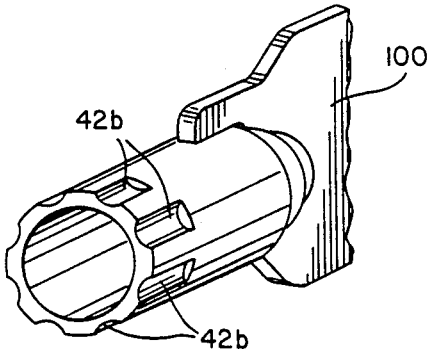
FIG. 8 is a fragmentary perspective view similar to FIG. 7, showing another form of reset key that can be used with the lock illustrated in FIG. 1.

It can thus be seen that when the tumblers are of a given size and positioned in a particular way that corresponds with the sizes of the notches in an operating key, the key can readily be used to open and close the lock as desired. The present invention, however, includes the capability of changing the arrangement of the respective tumblers, so that different operating keys are required to operate the lock, depending upon the tumbler orientation.. The rearrangement is accomplished by a reset key, and FIGS. 7 and 8 illustrate the configuration of a first 98 and a second 100 reset key, respectively. The reset keys are generally structurally similar to operating key 26, except that they do not include outer and inner lugs, 32 and 34, the absence of which permits the reset keys to be inserted into the lock opening in a number of different ways. The insertion of a reset key that has proper circumferential notches permits the respective tumblers to be so oriented within the respective bores that the interfaces between the operating pins and the second reset pins are in axial alignment with the plane defined by the interface between second inner sleeve 76 and inner ledge portion 66. When the pins are so arranged, second inner sleeve 76 can be rotated to any position, and when turned to provide alignment of different bores in the sleeve and the ledge portion, a different operating key will be required to operate the lock. Similarly, with the second reset key, when the interface of second reset pins 94 and first reset pins 92 coincides axially with the abutting faces of first and second inner sleeves 74 and 76, first sleeve 74 can be rotated relative to second sleeve 76 to, again, reposition the sleeves to change the axial alignment of the tumblers to require a different operating key to operate the lock.

Figure 9:
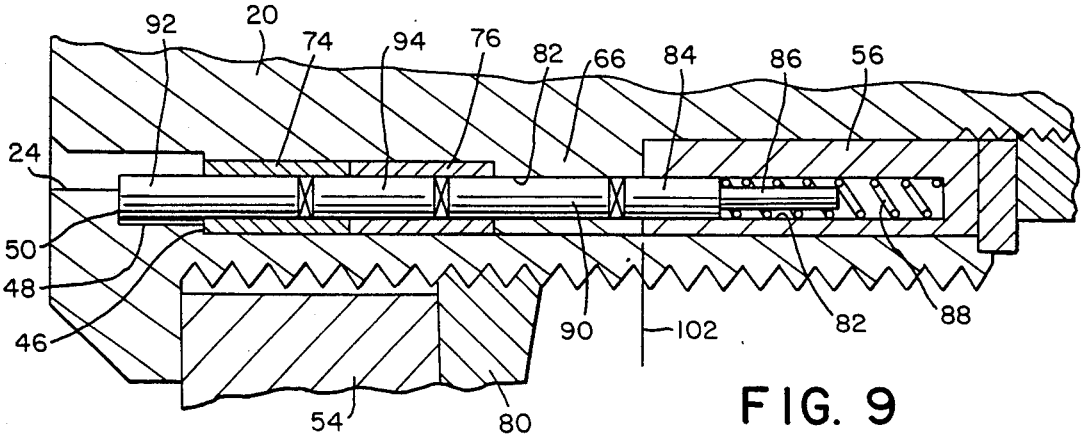
FIG. 9 is an enlarged, fragmentary cross-sectional view of the lock illustrated in FIG. 4, showing the positions of the tumbler pins in one aligned bore before the insertion of a key into the lock opening.

The operating and resetting operations can be best understood by referring to FIGS. 9 through 12 of the drawings. In that regard, FIG. 9 shows a single bore and the surrounding structure, as well as the relative alignment between the respective tumbler pins that are carried within that bore. In FIG. 9 no key has been inserted into the lock. As is apparent, the interface between inner concentric ledge 66 and inner sleeve 56, which defines the locking plane 102, is such that the innermost, biasing pins 84, extends across that plane, thereby preventing relative rotation between ledge 66 and sleeve 56. Similarly, operating pin 90 extends across the interface between second sleeve 76 and concentric ledge 66, to prevent relative rotation between those two members. At the same time, second reset pin 94 extends across the interface between first and second inner sleeves 74 and 76, to, again, prevent relative rotation between those members. Thus the lock as shown in FIG. 9 is in a locked condition, and when the parts are so positioned relative to each other the lock is incapable of permitting relative rotation between cylindrical inner body member 20 and housing 12.

Figure 10:
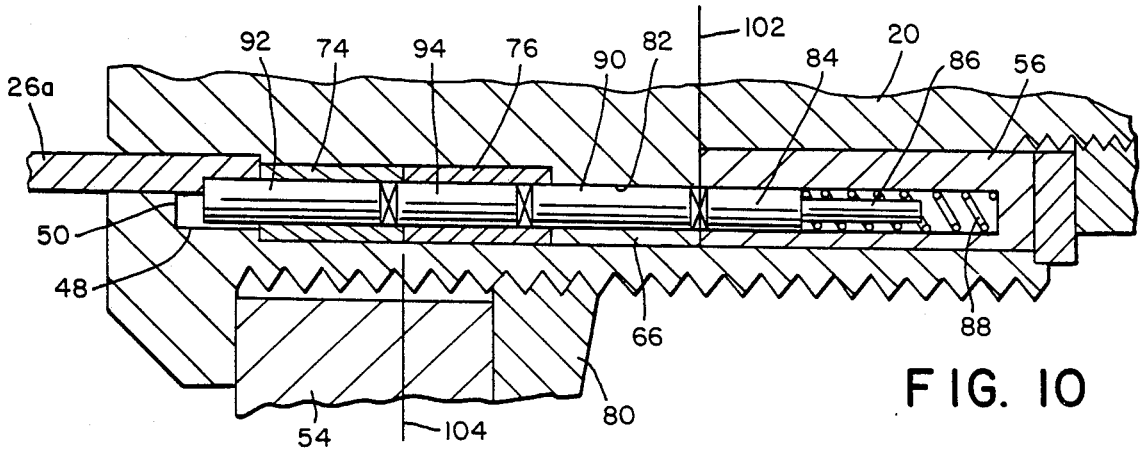
FIG. 10 is an enlarged, fragmentary cross-sectional view of the lock illustrated in FIG. 4, showing the positions of the tumbler pins in one aligned bore after the insertion of an operating key into the lock opening.

When a properly configures operating key is inserted into annular opening 24, specifically, an operating key 26a having a circumferential notch of the proper axial depth based upon the lengths of the tumbler pins in the particular axial bore, as shown in FIG. 10, first and second reset pins 92 and 94, operating pin 90, and innermost biasing pin 84 are each moved inwardly against the biasing action of spring 88 to a point at which the interface between operating pin 90 and biasing pin 84 is aligned with locking plane 102. Consequently, when the pins in the other axial bores 82 are similarly arranged with respect to locking plane 102, relative rotation between cylindrical inner body member 20 and housing 12 is permitted, and operating key 26a can then be turned to open the lock. Similarly, that same relative positioning of the tumbler pins exists when the lock is intended to be closed. In that regard, each of circumferential notches 42 formed on the operating key is of a predetermined axial length such that no pins extend across locking plane 102, in order to permit the lock to function properly.

Figure 11:
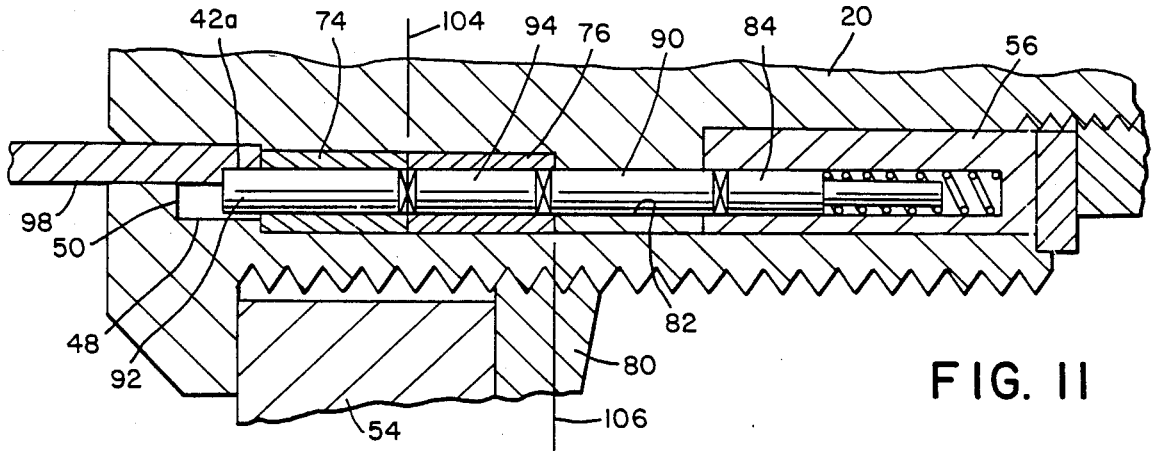
FIG. 11 is an enlarged, fragmentary cross-sectional view of the lock illustrated in FIG. 4 showing the positions of the tumbler pins in one aligned bore after the insertion of one form of resetting key into the lock opening.

If it is desired to alter the relative positions of the tumblers in one or more of bores 82, in order to require that a different operating key be used to operate the lock, a first reset key 98 of the type illustrated in FIG. 7 is inserted into the lock opening, and because of the particular axial lengths of circumferential notches 42*a* thereon, first reset pins 92 are moved inwardly into bores 82 so that the innermost ends of those pins coincide with the first reset plane 104 as illustrated in FIG. 11. At that point first inner sleeve 74 is capable of rotation relative to second inner sleeve 76, as well as rotation relative to cylindrical inner body member 20, to permit first inner sleeve to turn to cause a different first reset pin to be aligned with a given second reset pin, depending upon the position to which the reset key is turned. Thus, if the reset key is turned from the one o'clock position to the two o'clock position, referring to FIG. 3, different tumbler pin alignments are provided, thereby requiring a different operating key. When the reset key is axially withdrawn from the opening, the lock will have been reset to require a different operating key, and when an operating key having the correct circumferential notch lengths on its tubular outer surface is inserted, the tumbler pins will be so positioned that the interfaces between the respecive operating pins and biasing pins will, again, lie in locking plane 102, to permit relative rotation between cylindrical inner body member 20 and housing 12, to permit the lock to be unlocked and locked. Thus, it will be apparent that by rotating first reset key 98 to respective clockwise positions relative to the outer face 22 of the lock, a total of eight different tumbler combinations can be provided, each of which requires a separate operating key.

Figure 12:
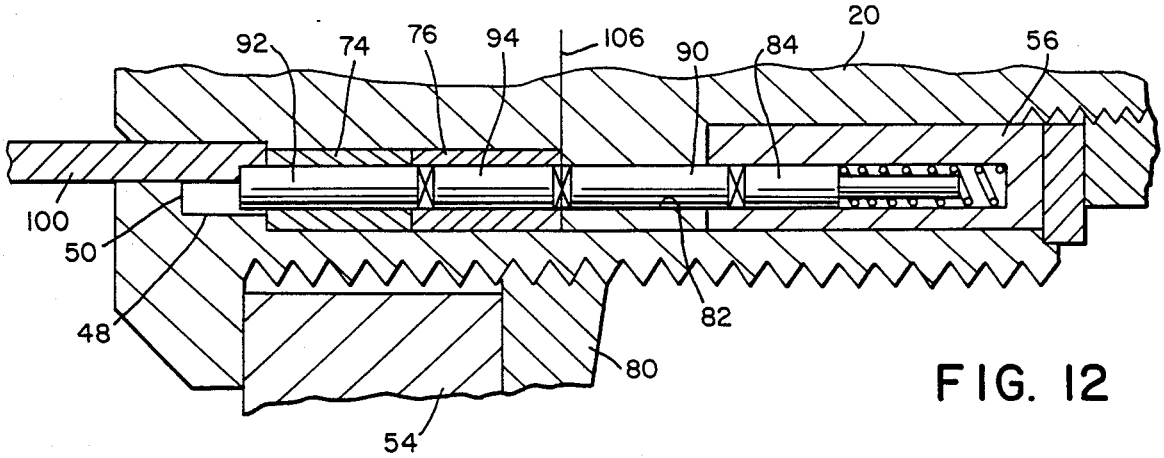
FIG. 12 is an enlarged, fragmentary cross-sectional view similar to FIG. 11, after the insertion of another form of resetting key into the lock opening.
Figure 13:
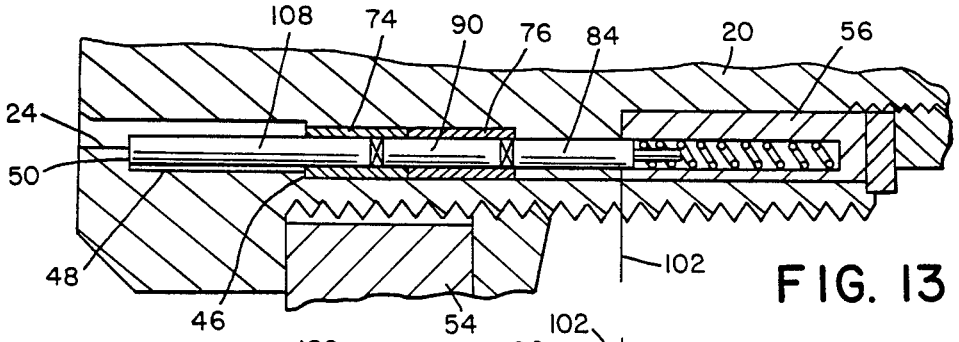
FIGS. 13 through 16 are similar to FIGS. 9 through 12, resepctively, and show the tumbler pin positions for a lock structure in which only three tumbler pins are positioned in each bore, rather than four tumbler pins.
Figure 14:
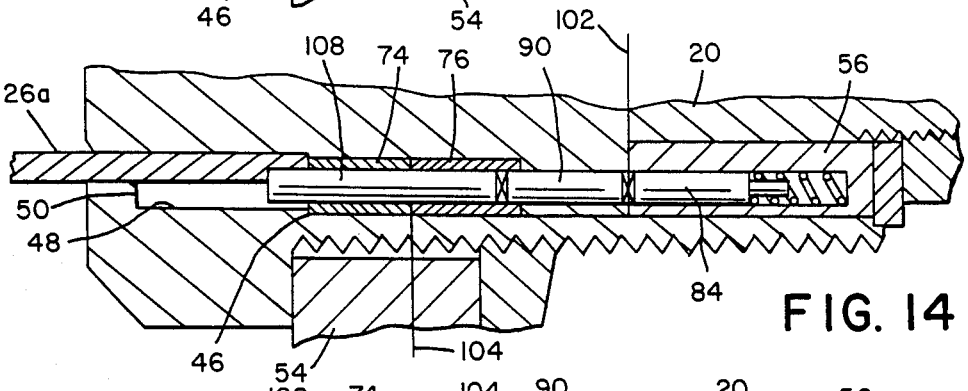
Figure 15:
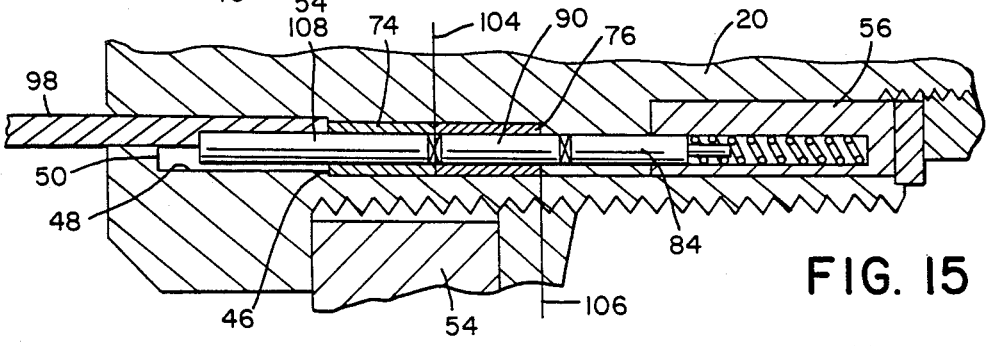
Figure 16:
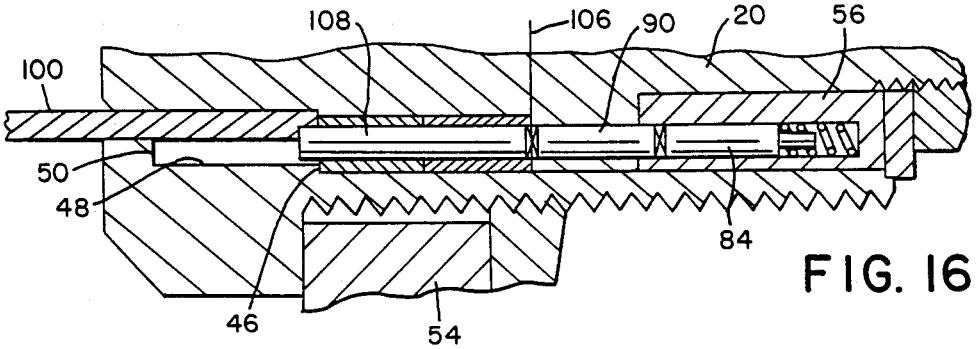

The relative positions of the tumblers can also be changed by inserting a second reset key 100, as illustrated in FIG. 12. The second reset key is so configured that the circumferential notches formed thereon cause the tubmlers to be shifted within the bores so that the interfaces between the respective second reset pins 94 and the operating pins 90 are aligned with each other and with a second reset plane 106, to permit the combination of the first and second inner sleeves 74 and 76 to be rotated together, as a unit, to, again, permit reorientation of the tumblers relative to each other and thereby require that different operating keys be employed. As is the case with first reset key 98, second reset key 100 can be rotated to any of eight different positions to provide different tumbler alignments. Thus it will be apparent tha by sequentially inserting and turning each of first and second reset keys 98 and 100, the relative rotation between first and second inner sleeves 74 and 76, and the relative rotation between second inner sleeve 76 and inner ledge portion 66 will permit a large number of different tumbler orientations, which will require a correspondingly large number of differently configured operating keys, thereby permitting numerous changes of the lock keying arrangement to thwart unintended access to the area that the lock is intended to secure.

If it is desired to further vary the number of possible operating keys that can be employed to operate the lock of the present invention, the lock can be disassembled so that the tumbler pins from one bore can be removed and exchanged with the tumbler pins from another bore in order to place tumbler pins into bores that are spaced circumferentially from the original bores in which those pins were positioned. In that event, new resetting keys will also be required.

The same effect as hereinabove described in the context of a lock having four tumbler pins in each axial bore can be obtained in a lock structure in which axial bore includes only three tumbler pins, as illustrated in FIGS. 13 through 16, which correspond with FIGS. 9 through 12, respectivley, showing the four tumbler pin structure and operation. In each of FIGS. 13 through 16 the same reference numerals identify corresponding parts of the structure, except the forwardmost pins are identified by reference numeral 108. Additionally, because of the longer length of pins 108, the axial spacing between first inner shoulder 46 and second inner shoulder 50 has been increased over that needed in the four tumbler embodiment. The operation of the three tumbler embodiment is substantially the same as that of the four tumbler embodiment.

It will thus be apparent to those skilled in the art that the lock structure in accordance with the present invention provides distinct advantages over the prior art lock structures, by permitting a wide variation in the tumbler arrangements to be made in a single lock structure.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. In an axial pin tumbler lock having a housing including an annular key opening at one end and a locking member at the other end, a cylindrical inner member rotatably carried within the housing and having a plurality of axially extending tumbler bores each having a plurality of cylindrical tumbler pins therein, the pins having respective axial lengths so that upon insertion into the key opening of a tubular operating key, respective tumblers are axially shifted within the tumbler bores so that interfaces between one pair of tumbler pins in each bore lie ina single plane transverse to the housing axis to permit the cylindrical inner member to be rotated relative to the housing and permit the locking member to be moved from a locking position to an unlocking position, the improvement comprising: first and second annular sleeves carried on and rotatable relative to the cylindrical inner member and rotatable relative to each other, each annular sleeve including a plurality of axially aligned tumbler bores equal in number to the number of tumbler bores in the cylindrical inner member and having their axes disposed in a circular array coaxial with the housing axis, the bores of each of the annular sleeves being axially aligned with corresponding tumbler bores in the inner cylindrical member, wherein the sleeves are in end-to-end contact to define a first tumbler reset plane and wherein one sleeve is in abutting contact with the inner cylindrical member to define a second tumbler reset plane.

2. An axial pin tumbler lock comprising:

(a) a tubular housing having an axis, and front and rear faces, the front face having an annular key opening;

(b) an inner cylindrical member rotatably carried within the housing and having a plurality of axially extending tumbler bores having their axes in a circular array concentric with the housing axis, the inner cylindrical member including locking tongue means extending outwardly therefrom at the rear face of the housing;

(c) a tubular sleeve nonrotatably carried within the tubular housing adjacent its rear face, the sleeve having a central bore to rotatably receive the cylindrical member and having a plurality of axially extending tumbler bores having their axes in a circular array concentric with the housing axis;

(d) a first cylindrical member in the form of an annular sleeve rotatably carried on the inner cylindrical member adjacent the front face of the housing;

(e) a second cylindrical member in the form of an annular sleeve rotatably carried on the inner cylindrical member inwardly of the first cylindrical member and coaxial therewith and in abutting contact therewith;

(f) each of the cylindrical members having a plurality of axially extending, aligned tumbler bores equal in number to the number of tumbler bores in the tubular sleeve,the tumbler bores of the cylindrical members disposed ina substantially circular array concentric with the housing axis and axially aligned with respective tumbler bores in the tubular sleeve, each bores adapted to axially slidably receive a plurality of cylindrical tumbler pins;

(g) a plurality of cylindrial tumbler pins positioned within each of the tumbler bores;

(h) spring means within each tumbler bore in the tubular sleeve to urge the respective tumbler pins in a direction toward the front face of the housing, the housing including an inwardly extending circular flange positioned adjacent the front face thereof to engage a portion of an outer end face of adjacent forwardmost tumbler pins to limit outward axial movement of the tumbler pins in the direction of the front face of the housing;

(i) stop means carried by the tubular sleeve to limit inward axial movement of the tumbler pins in the direction of the rear face of the housing;

(j) the inner cylindrical member and tubular sleeve having abutting surfaces extending transversely of the housing axis and defining a locking plane at their interface, the first and second cylindrical members having abutting surfaces extending transversely of the housing axis and defining a first reset plane at their interface, and the second and inner cylindrical members having abutting surfaces extending transversely of the housing axis and defining a second reset plane at their interface;

(k) wherein the tumbler pin lengths are selected so that a tubular operating key having external notches on a tubular portion and engageable with forwardmost ends of forwardmost tumbler pins when inserted into a key opening in the lock provides alignment of the tumblers to permit relative rotation of the inner clyindrical member and the tubular sleeve to open the lock, and wherein a first tubular reset key having external notches on a tubular portion and engageable with forwardmost ends of forwardmost tumbler pins provide alignment of the tumblers to permit relative rotation of the second cylindrical member relative to the inner cylindrical member to reset the tumblers to a plurality of first positions corresponding with the number of tumbler bores, and wherein a second tubular reset key having external notches on a tubular portion and engageable with forwardmost ends of forwardmost tumbler pins provides alignment of the tumblers to permit relative rotation of the first cylindrical member relative to the second cylindrical member to reset the tumblers to a plurality of second positions corresponding with the number of tumbler bores, the tumbler lengths being so selected that in each tumbler bore when ends of the respective tumblers coincide with one of the locking plane, the first reset plane,and the second reset plane, to permit relative rotation between respective adjacent cylindrical members, relative rotation of the cylindrical members occurs at only one of the planes.

3. An axial pin tumbler lock in accordance with claim 2, wherein the inner cylindrical member includes first and second end portions and an intermediate portion, the intermediate portion having a larger outer diameter than the end portions and housing the tumbler bores carried by the inner cylindrical member.

4. An axial pin tumbler lock in accordance with claim 3, wherein the second end portion is rotatably received in the tubular sleeve.

5. An axial pin tumbler lock in accordance with claim 3, wherein the first and second cylindrical members are rotatably carried on the first end portion of the inner cylindrical member.

6. An axial pin tumbler lock in accordance with claim 2, wherein the lock includes eight tumbler bores.

7. An axial pin tumbler lock in accordance with claim 2, wherein the tumbler bores each include four tumbler pins.

8. An axial pin tumbler lock in accordance with claim 2, wherein the tumbler bores each include three tumbler pins.

9. An axial pin tumbler lock in accordance with claim 2, wherein the tumbler pins in at least one tumbler bore each have axial lengths different from the axial lengths of corresponding tumbler pins in each of the other tumbler bores.

10. An axial pin tumbler lock in accordance with claim 2, wherein the tubular housing includes inner ledge means for spacing the first cylindrical member a predetermined distance inwardly of the front face of the housing.

11. An axial pin tumbler lock in accordance with claim 2, wherein the lock includes an annular key opening at the front face of the housing.

12. An axial pin tumbler lock in accordance with claim 11, wherein the key opening includes key guide means for guiding an operating key into the key opening at a predetermined orientation of the key relative to the tumbler bores.

13. An axial pin tumbler lock in accordance with claim 2, wherein correspondingly positioned tumbler pins in each tumbler bore have different axial lengths.

* * * * *